US009844862B1

(12) United States Patent
Velez

(10) Patent No.: US 9,844,862 B1
(45) Date of Patent: Dec. 19, 2017

(54) FASTENER-DRIVING TOOL

(71) Applicant: Dennys Velez, Grand Prairie, TX (US)

(72) Inventor: Dennys Velez, Grand Prairie, TX (US)

( * ) Notice: Subject to any disclaimer, the term of this patent is extended or adjusted under 35 U.S.C. 154(b) by 282 days.

(21) Appl. No.: 14/930,824

(22) Filed: Nov. 3, 2015

(51) Int. Cl.
*B25B 23/00* (2006.01)

(52) U.S. Cl.
CPC ..... *B25B 23/0035* (2013.01)

(58) Field of Classification Search
CPC ..... B25B 23/0021; B25B 23/0035; B25B 23/0007; B25B 13/48; B25G 1/01; B25G 1/02; B25G 1/04; B25G 1/043
See application file for complete search history.

(56) References Cited

U.S. PATENT DOCUMENTS

| | | | | |
|---|---|---|---|---|
| 1,624,530 | A | 4/1927 | Caruso | |
| 3,707,894 | A | 1/1973 | Stillwagon | |
| 4,730,960 | A * | 3/1988 | Lewis | B25B 13/06 408/127 |
| 6,862,958 | B2 * | 3/2005 | Schade | B25B 23/0021 403/223 |
| 6,952,986 | B2 * | 10/2005 | Fu | B25B 23/0021 403/157 |
| 7,044,031 | B1 | 5/2006 | Mullen | |
| 7,204,177 | B1 | 4/2007 | Garner | |
| 8,117,950 | B2 * | 2/2012 | Kozak | B23B 45/005 81/177.6 |
| D659,730 | S | 5/2012 | Cantlon | |
| 8,789,447 | B2 * | 7/2014 | Kozak | B23B 45/005 81/177.6 |
| 9,623,487 | B2 * | 4/2017 | Kozak | B23B 45/005 |
| 2006/0254394 | A1 | 11/2006 | Cantlon | |
| 2010/0058897 | A1 | 3/2010 | Alsobrook | |
| 2014/0060265 | A1 * | 3/2014 | Kozak | B25B 23/0028 81/436 |

FOREIGN PATENT DOCUMENTS

| | | |
|---|---|---|
| DE | 202006010636 U1 | 8/2006 |

* cited by examiner

*Primary Examiner* — David B Thomas
(74) *Attorney, Agent, or Firm* — Kyle A. Fletcher, Esq.

(57) ABSTRACT

The fastener drive tool is a hand powered drive device that is used to drive fasteners around an axis. The fastener tool device is formed in the shape of a cylinder. The first end of the fastener drive tool is designed to receive driver bits designed for use with power drills, including, but not limited to, 6 point, 12 point, flat head, Phillips head, and star driver bits and driver bit sets. The second end of the cylinder is designed to receive a square driver bits commonly used for driver sockets. Optionally, the first end and the second end can be fitted with a ratchet device. The fastener drive tool comprises a flexible steel wire, a rubber covering, a woven steel lube, a first driver port, and a second driver port.

17 Claims, 3 Drawing Sheets

FASTENER-DRIVING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tools as a means for driving around an axis, more specifically, a hand tool for driving bolts and holding nuts.

SUMMARY OF INVENTION

The fastener drive tool is a hand powered drive device that is used to drive fasteners around an axis. The fastener tool device is formed in the shape of a cylinder. The first end of the fastener drive tool is designed to receive driver bits designed for use with power drills, including, but not limited to, 6 point, 12 point, flat head, Phillips head, and star driver bits and driver bit sets. The second end of the cylinder is designed to receive a square driver bit driver bits commonly used for driver sockets. Optionally, the first end and the second end can bee fitted with a ratchet device.

These together with additional objects, features and advantages of the fastener drive tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the fastener drive tool in detail, it is to be understood that the fastener drive tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fastener drive tool.

It is therefore important that the claims be regarded as including such equivalent construction insofar as they do not depart from the spirit and scope of the fastener drive tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
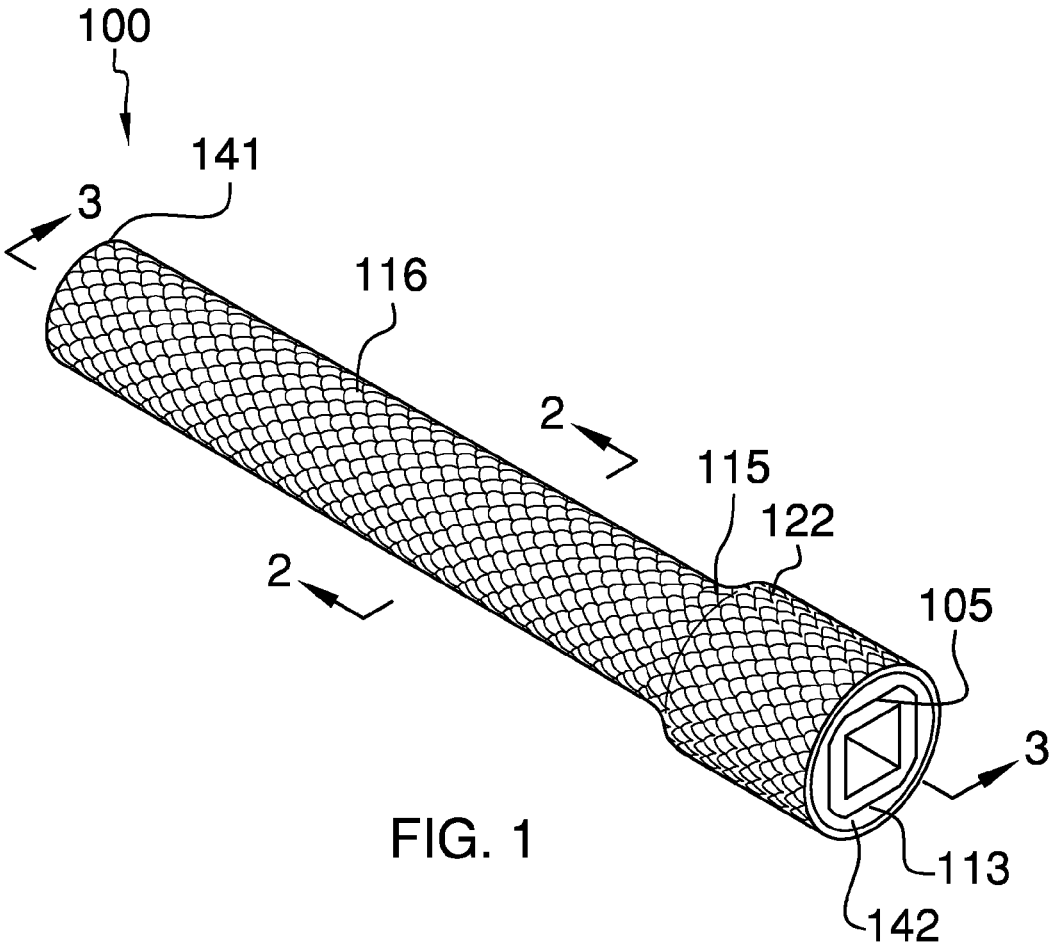
FIG. 1 is a perspective view of an embodiment of the disclosure.
Figure 2:
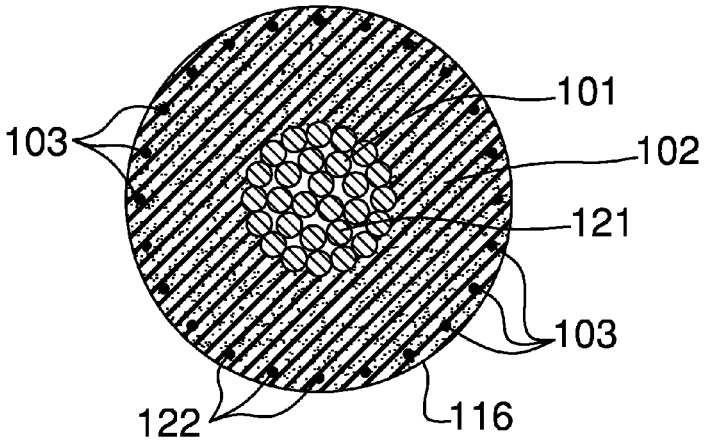
FIG. 2 is a cross-sectional view of an embodiment of the disclosure across 2-2.
Figure 3:
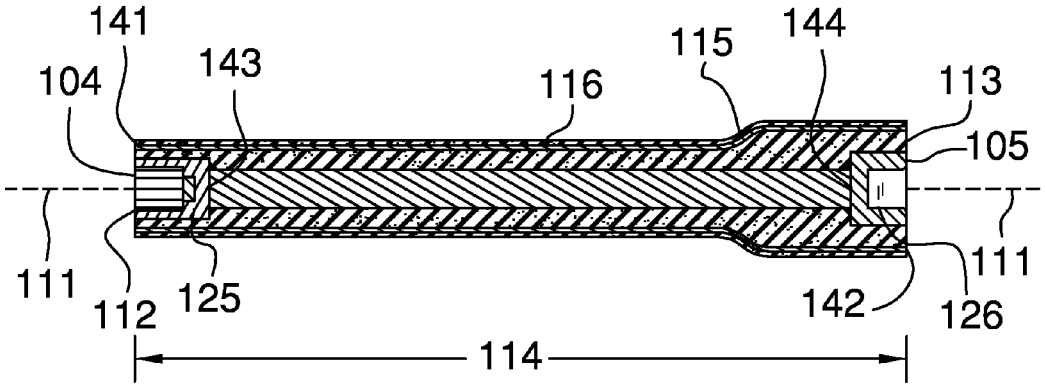
FIG. 3 is a cross-sectional view of an embodiment of the disclosure.
Figure 4:
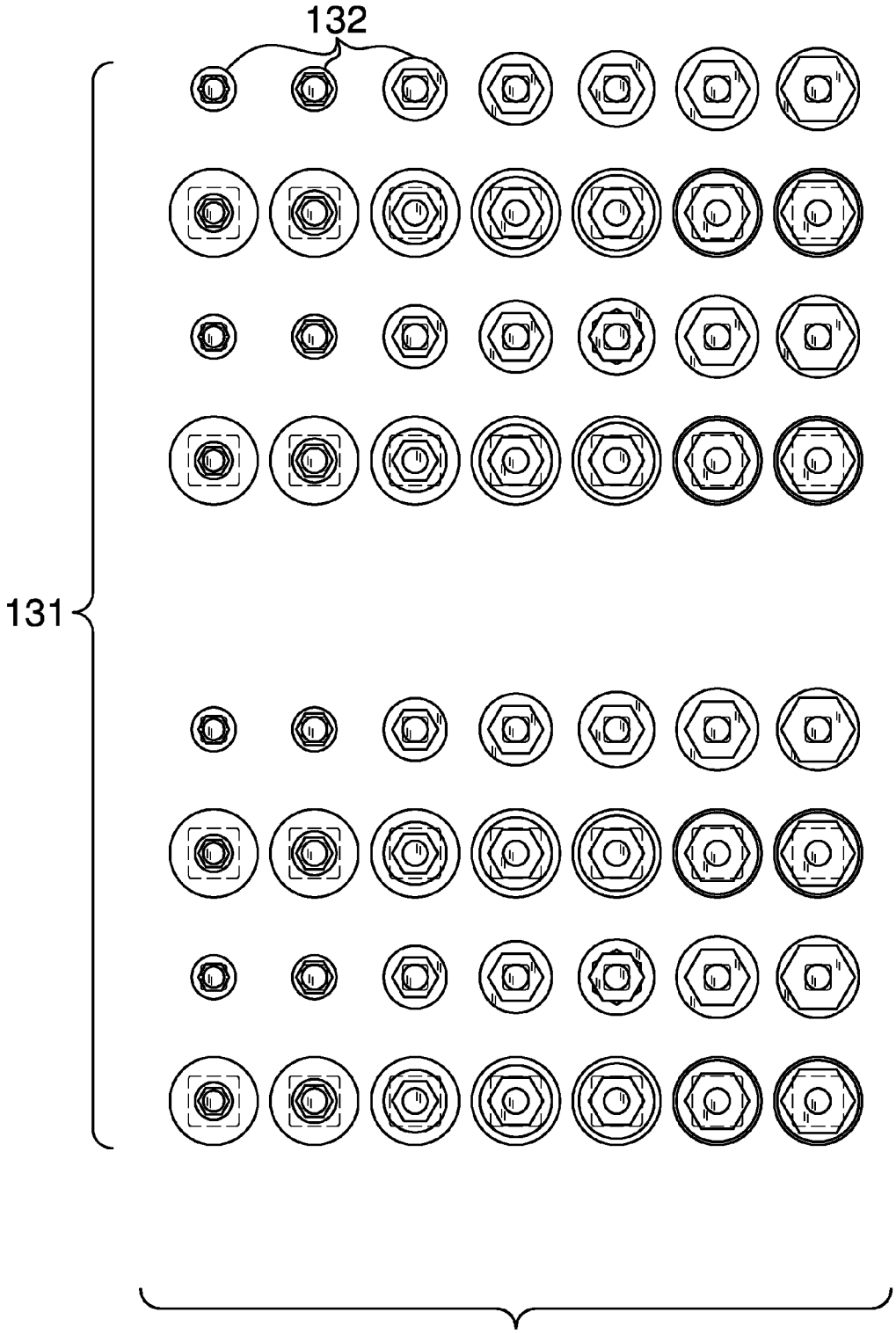
FIG. 4 is a detail view of an embodiment of the disclosure.

Detailed reference will now be made to a first potential embodiment of the disclosure, which is illustrated in FIGS. 1 through 4. The fastener drive tool 100 (hereinafter invention) comprises a flexible steel wire 101, a rubber covering 102, a hardened flexible woven steel tube 103, a first driver port 104, and a second driver port 105. The invention 100 is further defined with a first end 141 and a second end 142.

The flexible steel wire 101 is a metal cylinder braided from a first plurality of steel wires 121. The design of the flexible steel wire 101 provides for an elasticity that allows the flexible steel wire 101 to bend slightly along the center axis 111 of the metal cylinder and to twist around the center axis 111 of the metal cylinder. The purpose of this elasticity is to 1) prevent slippage while tightening of the individual driver head 132 by allowing adjustment during torqueing of the individual driver head 132; and, 2) to improve the comfort and ease of use for the user.

The flexible steel wire 101 is further defined with a third end 143 and a fourth end 144. The third end 143 of the flexible steel wire 101 is proximal to the first end 141 of the invention 100 and the fourth end 144 of the flexible steel wire 101 is proximal to the second end 142 of the invention 100. The first driver port 104 is attached to the third end 143 of the flexible steel wire 101. The first driver port 104 is a port that is designed to receive and securely hold driver bits designed for use with tools such as power drills, including, but not limited to, 6 point, 12 point, flat head, Phillips head, and star driver bits and driver bit sets. The first driver port 104 is a commercially available item that can be attached to the flexible steel wire 101 using several methods including, but not limited to, welding, brazing, or the use of commonly available hardware such as a cotter pin.

The first driver port 104 can be sized to receive 0.250 or 0.375 inch driver bits. Optionally the first driver port 104 can be magnetized. The second driver port 105 is attached to the fourth end 144 of the flexible steel wire 101. The second driver port 105 is a port that is designed to receive and securely hold square driver bits commonly used for driver sockets. The second driver port 105 is a commercially available item that can be attached to the flexible steel wire 101 using several methods including, but not limited to, welding, brazing, or the use of commonly available hardware such as a cotter pin. The second driver port 105 can be sized to receive 0.250 or 0.500 inch driver bits. Optionally the second driver port 105 can be magnetized.

In as second potential embodiment of the disclosure, the first drive port 104 is fitted with a first ratchet device 125 and the second drive port 105 is fitted with a second ratchet device 126 for the convenience of the user.

The exterior faces of the flexible steel wire 101, the first driver port 104, and the second driver port 105 are covered in a rubber covering 102. The rubber covering 102 does not cover the first end 141 or the second end 142 of the invention 100 and therefore does not inhibit access to the first driver port 104 or the second driver port 105. The purpose of the rubber covering 102 is to protect the flexible steel wire 101, the first driver port 104, and the second driver port 105 from damage and to provide comfort for the user. The rubber covering 102 can be formed from a natural rubber, such as latex, or a synthetic rubber, such as polyurethane. The rubber covering 102 is applied to the flexible steel wire 101, the first driver port 104, and the second driver port 105 to form a tube. In order to accommodate the larger driver, the diameter of the second face 113 of the second end 142 is greater than the diameter of the first face 112 of the first end 141. Along the flexible steel wire 101, at a point that is a distance from the fourth end 144 of between 20% and 40% of the overall length 114 of the flexible steel wire 101, the diameter of the second face 113 tapers 115 down to match the diameter of the first face 112.

The outer surface 116 of the rubber cover 102 has embedded in it a hardened flexible woven steel tube 103. The hardened flexible woven steel tube 103 is a flexible tube that is woven from a second plurality of steel wires 122. Methods to weave a tube from a second plurality of steel wires 122 are well known and documented in the art. The purpose of the hardened flexible woven steel tube 103 is to protect the rubber cover 102 from damage and to improve the grip of the user when using the invention 100.

To use the first potential embodiment of the disclosure and the second potential embodiment of the disclosure, an individual driver head 132 is selected from a set of drives that comprises a plurality of driver heads 131. The selected individual driver head 132 is inserted into the first driver port 104 or the second drive port 105, whichever is appropriate and placed over the fastener to be driven. The first potential embodiment of the disclosure is then rotated around the center axis 111 in order to drive the fastener into position.

The following definitions were used in this disclosure:

Braid: As used in this disclosure, a braid is a flat, round or tubular narrow fabric made by intertwining a set of yarns in a definite pattern. As a verb, to braid refers to the process of forming a braid.

Ratchet: As used in this disclosure, a ratchet is a device comprising a pawl or hinged catch that engages the sloping teeth of a wheel or bar permitting motion in one direction only.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A fastener driving tool comprising:

a flexible steel wire, a rubber covering, a hardened flexible woven steel tube, a first driver port, and a second driver port;

wherein the fastener driving tool is adapted for use with driver bits adapted for use with power tools;

wherein the fastener driving tool is adapted for use with square driver bits for use with driver sockets;

wherein the fastener driving tool is further defined with a first end and a second end.

2. The fastener driving tool according to claim 1 wherein the first driver port is magnetized;

wherein the second driver port is magnetized.

3. The fastener driving tool according to claim 2 wherein the flexible steel wire is a metal cylinder braided from a first plurality of steel wires.

4. The fastener driving tool according to claim 3 wherein the design of the flexible steel wire provides for an elasticity that allows the flexible steel wire to bend slightly along the center axis of the metal cylinder.

5. The fastener driving tool according to claim 4 wherein the design of the flexible steel wire provides for an elasticity that allows the flexible steel wire to twist around the center axis of the metal cylinder;

wherein the flexible steel wire is further defined with a third end and a fourth end.

6. The fastener driving tool according to claim 5 wherein the first driver port is attached to the third end of the flexible steel wire;

wherein the second driver port is attached to the fourth end of the flexible wire.

7. The fastener driving tool according to claim 6 wherein the first driver port is attached to the third end.

8. The fastener driving tool according to claim 7 wherein the first driver port is designed to receive and securely hold driver bits designed for use with power tools.

9. The fastener driving tool according to claim 8 wherein the first driver port is sized to receive 0.250 or 0.375 inch driver bits.

10. The fastener driving tool according to claim 7 wherein the second driver port is attached to the fourth end of the flexible steel wire.

11. The fastener driving tool according to claim 10 wherein the second driver port is a port that is designed to receive and securely hold square driver bits.

12. The fastener driving tool according to claim 11 wherein the second driver port is sized to receive 0.25 or 0.50 square driver bits.

13. The fastener driving tool according to claim 10 wherein the first drive port is fitted with a first ratchet device;

wherein the second drive port is fitted with a second ratchet device.

14. The fastener driving tool according to claim 10 wherein the exterior faces of the flexible steel wire, the first driver port, and the second driver port are covered in a rubber covering such that the rubber covering does not cover the first end or the second end.

15. The fastener driving tool according to claim 14 wherein the diameter of the second end is greater than the diameter of the first end;

wherein along the flexible steel wire, at a point that is a distance from the fourth end of between 20% and 40% of the overall length of the flexible steel wire, the diameter of the second face tapers down to match the diameter of the first face.

16. The fastener driving tool according to claim 15 wherein the outer surface of the rubber cover has embedded in it a hardened flexible steel tube.

17. The fastener driving tool according to claim 16 wherein the hardened flexible steel tube is a flexible tube that is woven from a second plurality of steel wires.

* * * * *